US006244925B1

(12) United States Patent
Chou

(10) Patent No.: US 6,244,925 B1
(45) Date of Patent: Jun. 12, 2001

(54) MOTION TOY

(76) Inventor: Jin-Long Chou, 10F, No. 218, Sec. 3, Da-Tung Road, Hsi-Chih Chen, Taipei Hsien (TW)

( * ) Notice: Subject to any disclaimer, the term of this patent is extended or adjusted under 35 U.S.C. 154(b) by 0 days.

(21) Appl. No.: 09/250,295

(22) Filed: Feb. 17, 1999

(51) Int. Cl.[7] ..... A63H 13/00; A63H 3/46; G09F 19/08

(52) U.S. Cl. ..... 446/354; 446/384; 40/418

(58) Field of Search ..... 446/330, 338, 446/352, 353, 354, 376, 384, 326; 40/411, 415, 418

(56) References Cited

U.S. PATENT DOCUMENTS 2,637,936 * 5/1953 Dale et al. ..... 40/418 X
4,901,459 * 2/1990 Lee ..... 446/354 X
5,911,617 * 6/1999 Chou ..... 446/353
5,941,756 * 8/1999 Chou ..... 446/330
6,071,170 * 6/2000 How ..... 446/330

* cited by examiner

*Primary Examiner*—D. Neal Muir
(74) *Attorney, Agent, or Firm*—Bacon & Thomas, PLLC

(57) ABSTRACT

A motion toy, which includes a toy body, and a power drive unit, the toy body having a front body shell and a rear body shell fastened together, two arms coupled to the body shells at two opposite lateral sides, a head pivotably mounted in the body shells at a top side by a pivot and coupled to the arms, two feet, and two legs coupled between the body shells and the feet, wherein two elongated links are coupled between the arms and a rocker, which is turned back and forth about a pivot between the body shells by a center gear of the power drive unit, for enabling the arms to be synchronously turned back and forth when the legs are moved back and forth by the center gear of the power drive unit relative to the feet, and two Z-shaped links are coupled between the arms and a bottom coupling rod at the head for enabling the head to be oscillated upon the motion of the arms.

6 Claims, 8 Drawing Sheets

MOTION TOY

BACKGROUND OF THE INVENTION

The present invention relates to toys, and more particularly to a motion toy which comprises a toy body, and a power drive unit installed in the toy body and controlled to turn the head, arms and legs of the toy body.

A variety of motion toys have been disclosed, and have appeared on the market. These motion toys commonly use a reversible motor to turn a set of gears and an eccentric rod or wheel, so as to move movable parts of the toy body. The driving mechanisms for the conventional motion toys are commonly complicated and expensive. Further, the motion of the movable parts of the toy body are unstable. FIGS. 8 and 9 show another structure of motion toy, which is an invention of the present inventor, and was patented in Taiwan under Patent No. 334837 issued on Jun. 21, 1998. The power drive unit of this structure of motion toy comprises a reversible motor, a drive gear securely mounted on the output shaft of the reversible motor, two main sector gears and four auxiliary sector gears respectively mounted in the legs and the front and rear body shells of the toy body and meshed with the drive gear for enabling the legs to be turned leftwards and rightwards alternatively. This structure of motion toy is designed to let the legs be turned leftward and rightwards relative to the body shells. Because the arms of the motion toy are not relatively turned when the legs are moved by the power drive unit, the motion of this structure of motion toy is less attractive.

SUMMARY OF THE INVENTION

According to one aspect of the present invention, the motion toy comprises a toy body, the toy body comprising a front body shell and a rear body shell fastened together, two arms coupled to the body shells at two opposite lateral sides, a head pivotably mounted in the body shells at a top side by pivot means and coupled to the arms, two feet, and two legs coupled between the body shells and the feet, an a power drive unit controlled to turn the arms, legs and head of the toy body, wherein two elongated links are coupled between the arms and a pivot at a rocker, which is turned back and forth about a pivot between the body shells by a center gear of the power drive unit, for enabling the arms to be synchronously turned back and forth when the legs are moved back and forth by the center gear of the power drive unit relative to the feet. According to another aspect of the present invention, two Z-shaped links are coupled between the arms and a bottom coupling rod at the head, for enabling the head to be oscillated upon the motion of the arms. According to still another aspect of the present invention, the elongated links which are coupled between the rocker and the arms each comprise a respective hooked middle part connected to each other by spring means, a first elongated sliding slot at one end coupled to the pivot at the rocker, and a second elongated sliding slot at an opposite end coupled to a respective coupling rod at one of the arms. According to still another aspect of the present invention, the Z-shaped links which are coupled between the arms and the coupling rod at the head each comprise a respective hooked middle part connected to each other by spring means, a first elongated sliding slot at one end coupled to a respective coupling rod at one of the arms, and a second elongated sliding slot at an opposite end coupled to the coupling rod at the head.

DETAILED DESCRIPTION OF THE PREFERRED EMBODIMENT

Figure 1:
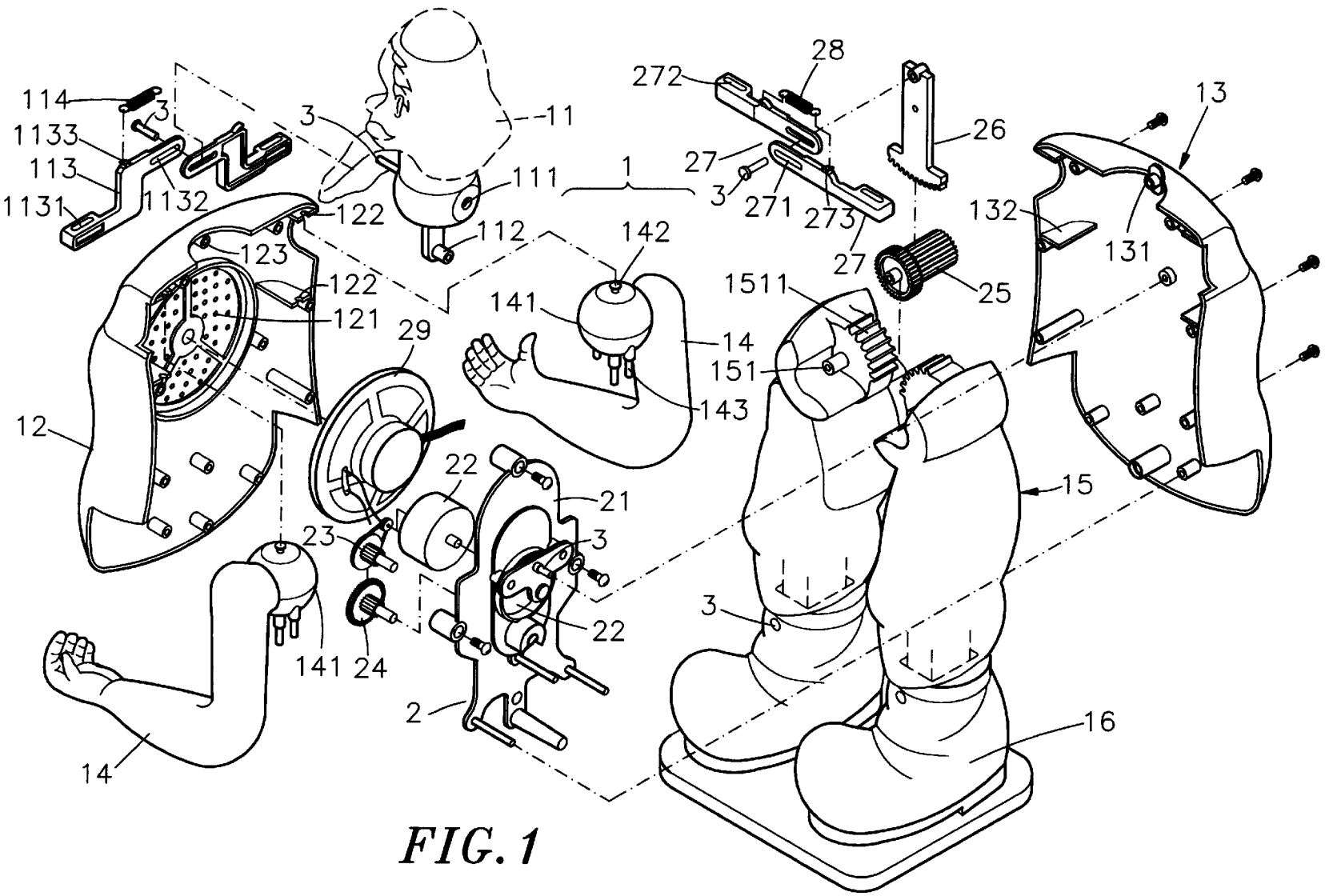
FIG. 1 is an exploded view of a motion toy according to the present invention.
Figure 2:
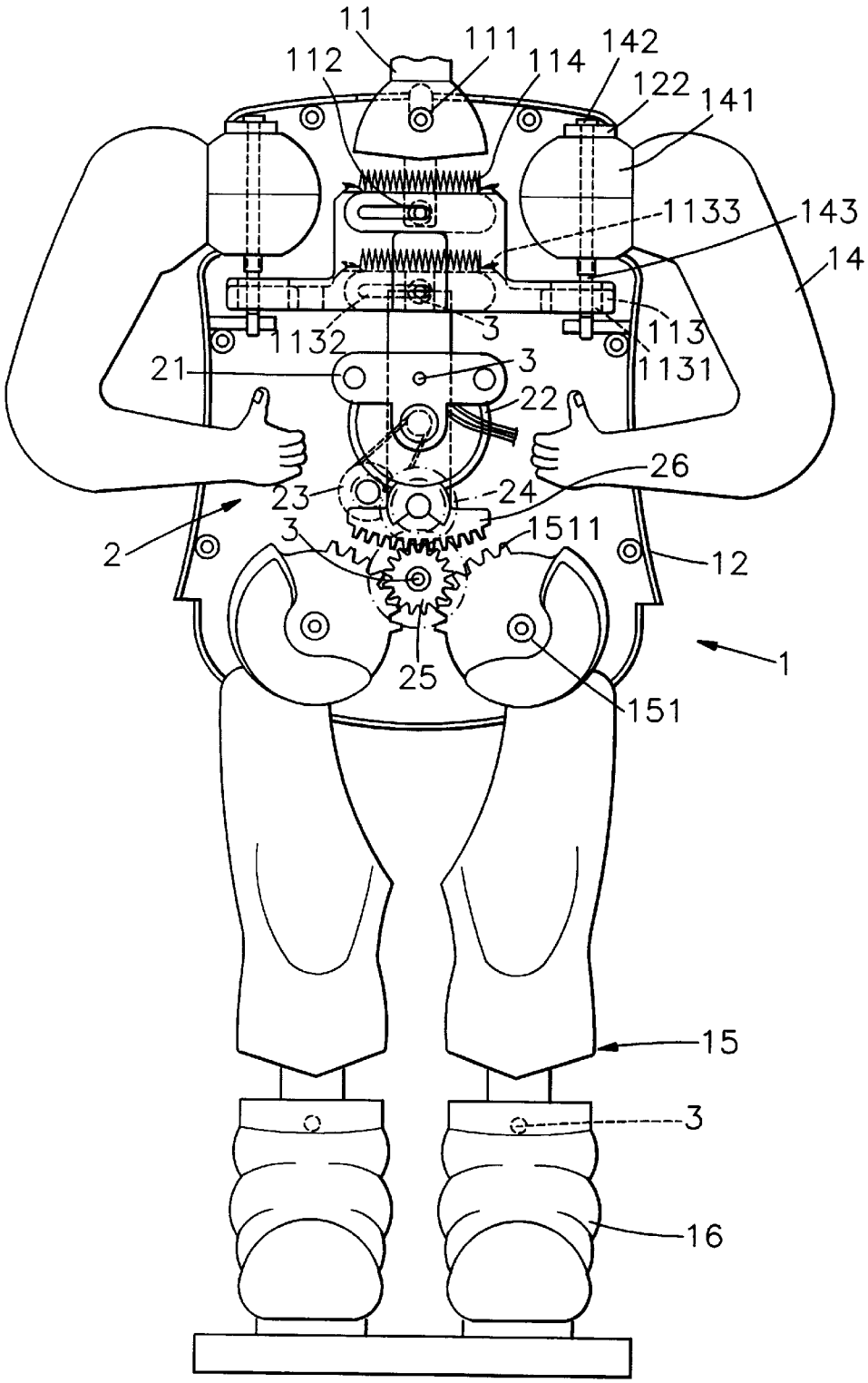
FIG. 2 is a perspective front view of the motion toy according to the present invention.
Figure 3:
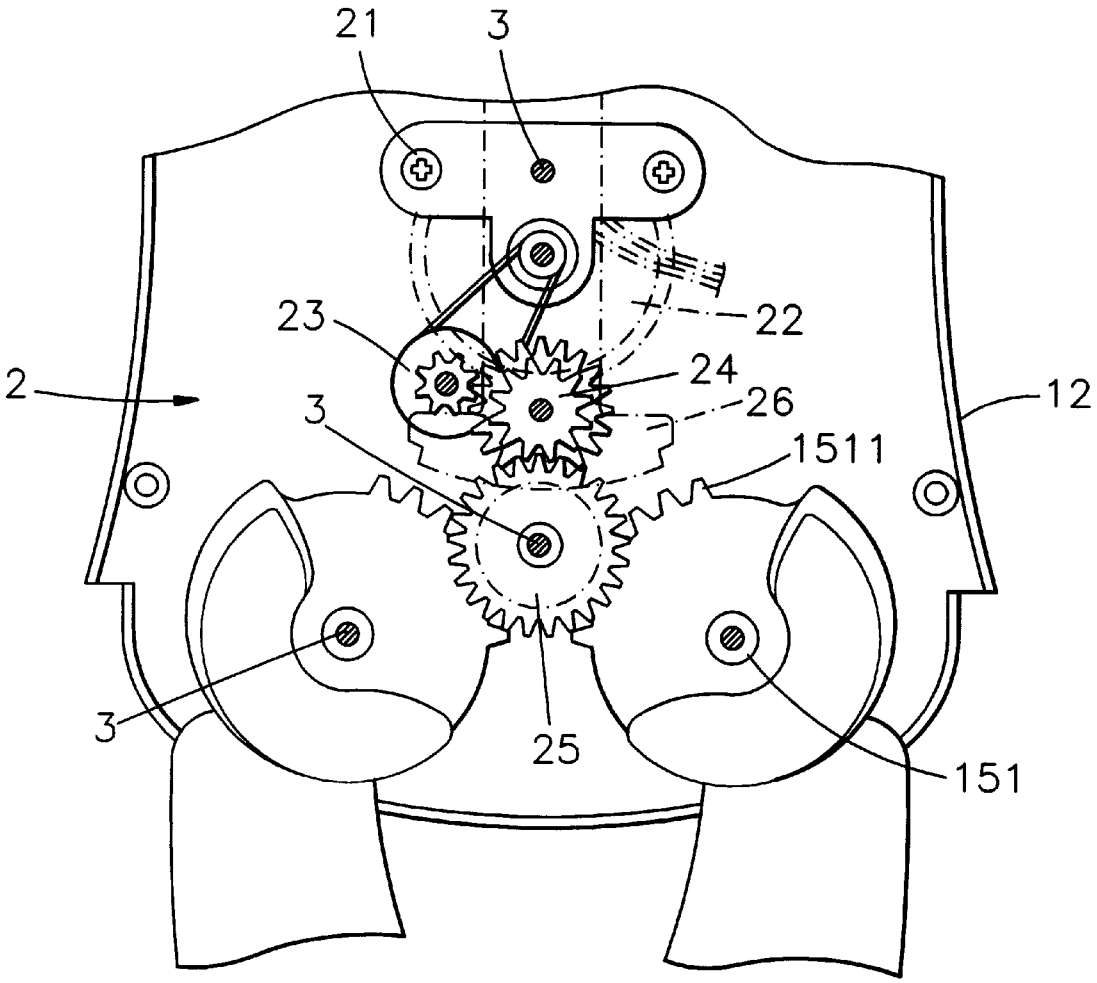
FIG. 3 is a perspective front view in an enlarged scale of a part of the motion toy according to the present invention.

Referring to FIGS. 1 and 2, a motion toy in accordance with the present invention is generally comprised of a toy body 1, a power drive unit 2, and a plurality of pivots 3.

The toy body 1 comprises a head 11, a front body shell 12, a rear body shell 13, two arms 14, two legs 15, and two feet 16. The head 11 comprises a pivot hole 111 near its bottom side pivotably connected between a top pivot hole 123 at the front body shell 12 and a top pivot hole 131 at the rear body shell 13 by a pivot 3, and a coupling rod 112 downwardly extended from its bottom side. The coupling rod 112 is coupled to the arms 14 by two Z-shaped links 113. The Z-shaped links 113 each comprise a first elongated sliding slot 1131 at one end, a second elongated sliding slot 1132 at an opposite end, and a hook 1133 on the middle. The second elongated sliding slots 1132 of the Z-shaped links 113 are respectively coupled to the coupling rod 112 of the head 11 by one pivot 3. The first elongated sliding slots 1131 of the Z-shaped links 113 are respectively coupled to the arms 14. A spring 114 is connected between the hooks 1133 at the Z-shaped links 113 to pull the Z-shaped links 113 toward each other. The arms 14 each comprise a fixed ball 141 at one end, two coupling rods 143 raised from the fixed ball 131 and arranged in parallel, and an axle 142 extended across the fixed ball 141. The axle 142 at the fixed ball 141 of each arm 14 is coupled between a respective sliding groove 122 at the front body shell 12 and a respective axle supporting plate 132 at the rear body shell 13. One of the coupling rods 143 at the fixed ball 141 of each arm 14 is respectively coupled to the first elongated sliding slots 1131 at the Z-shaped link 113. The other of the coupling rods 143 at the fixed ball 141 of each arm 14 is respectively coupled to two elongated links 27. The elongated links 27 each comprise a first elongated sliding slot 271 at one end, a second elongated sliding slot 272 at an opposite end, and a hook 273 on the middle. A spring 28 is connected between the hooks 273 at the elongated links 27 to pull the links 27 toward each other. The second sliding slots 272 of the elongated slinks 27 are respectively coupled to one of the coupling rods 143 at the fixed ball 141 of each arm 14. The first elongated sliding slots 271 of the elongated links 27 are respectively pivoted to a rocker 26 of the power drive unit 2. The rocker 26 is turned about a pivot 3 at a base frame 21 of the power drive unit 2, having a top end pivotably coupled to the first elongated sliding slots 271 at the elongated links 27, and a bottom end formed with a smoothly arch rack meshed with a center gear 25 of the power drive unit 2. The axle 142 at the fixed ball 141 of each arm 14 is coupled between a respective sliding groove 122 at the front body shell 12 and a respective axle supporting plate 132 at the rear body shell 13. The center gear 25 is turned about one pivot 3 near the bottom side of the base frame 21. A speaker 29 is mounted in a perforated speaker seat 121 inside the front body shell 12. The power drive unit 2 further comprises a reversible motor 22 mounted in the base frame 21, a belt transmission mechanism 23, a transmission gear 24 meshed with the center gear 25 and coupled to the motor 22 by the belt transmission mechanism 23. The legs 15 are respectively pivoted to the feet 16 by a respective pivot 3. Each of the legs 15 comprises a sector-like rack 1511 disposed at the top and meshed with the center gear 25, and a shaft 151 formed integral with the sector-like rack 1511 and pivotably coupled between the front body shell 12 and the rear body shell 13 by a respective pivot 3.

Referring to FIGS. from 3 through 5 and FIGS. 1 and 2 again, the reversible motor 22 is controlled by a control circuit (not shown) to turn the belt transmission mechanism 23 alternatively forwards and backwards, causing the center gear 25 to be rotated by the transmission gear 24 clockwise and counter-clockwise alternatively. Because the center gear 25 is meshed with the sector-like racks 1511 at the legs 15 and the smoothly arched rack at the rocker 26, rotating the center gear 25 causes the legs 15 and the rocker 26 to be oscillated. When the sector-like racks 1511 of the legs 15 are moved back and forth by the center gear 25, the legs 15 are synchronously bent rightwards and leftwards relative to the feet 16 and the body shells 12 and 13. During the motion of the legs, the rocker 26 is driven to move the elongated links 27, thereby causing the arms 14 to be turned back and forth. Because the fixed balls 141 of the arms 14 are coupled to the coupling rod 112 at the head 11 through the Z-shaped links 113, the head 11 is oscillated reversed to the body shells 12 and 13 during the motion of the rocker 26.

Figure 4:
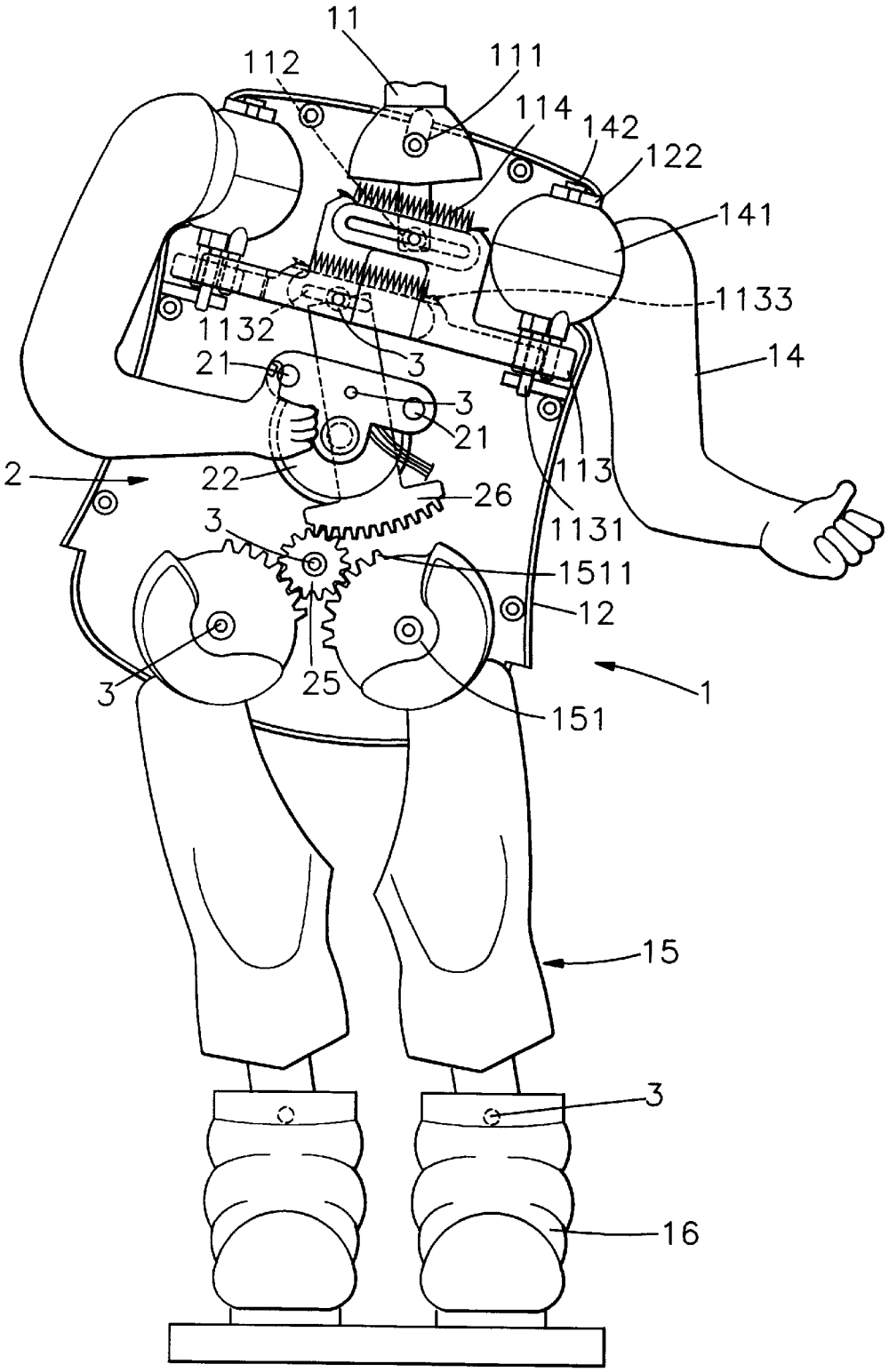
FIG. 4 is an operational view of the present invention, showing the motion toy bent rightwards.
Figure 5:
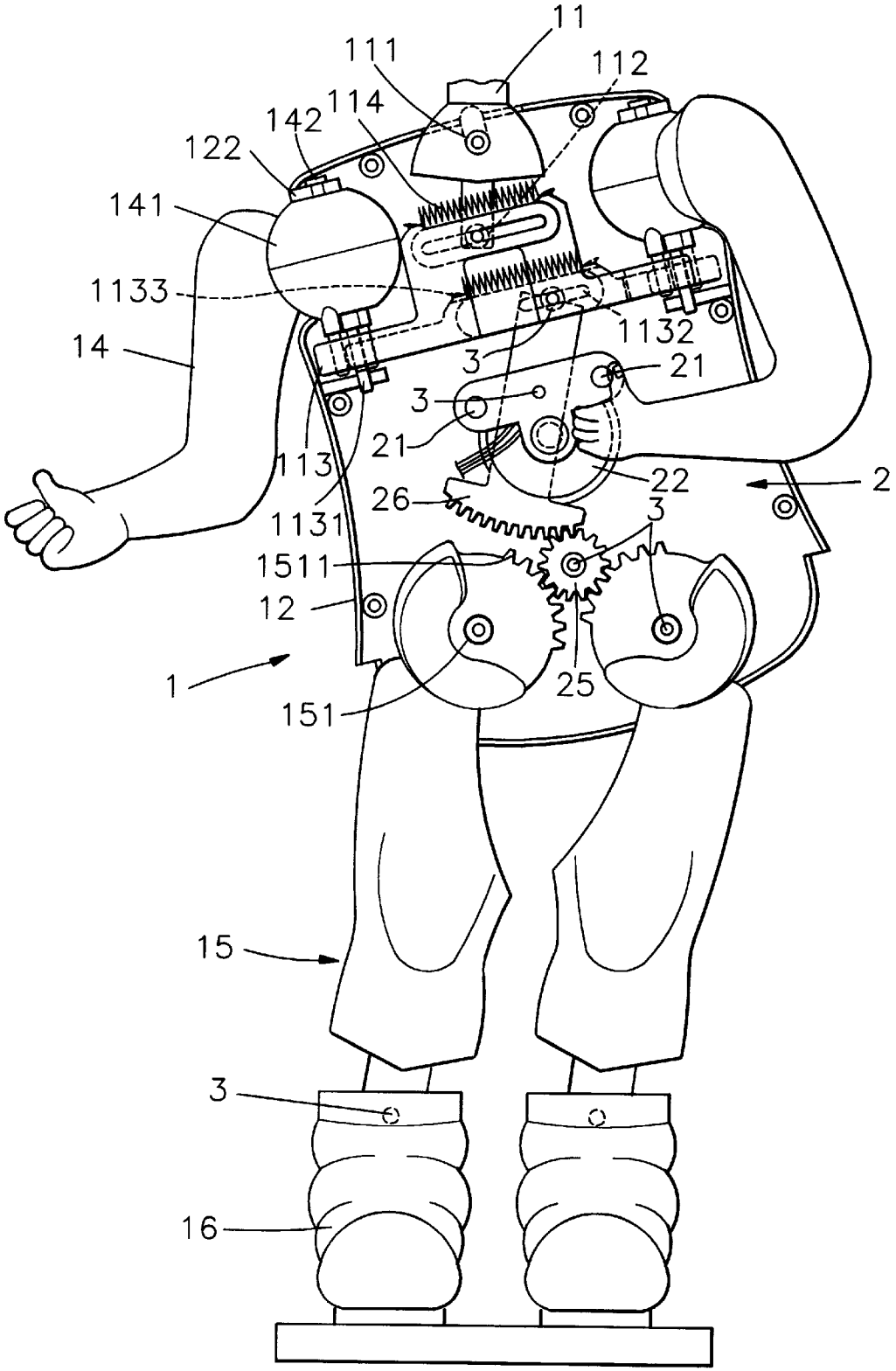
FIG. 5 is an operational view of the present invention, showing the motion toy bent leftwards.
Figure 6:
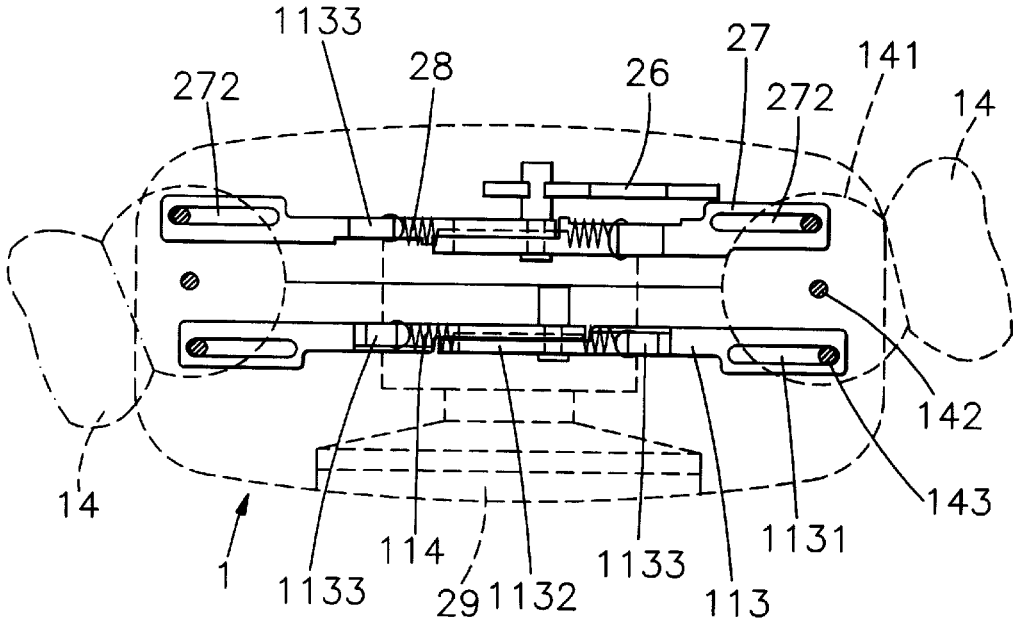
FIG. 6 is a top view of FIG. 4.
Figure 7:
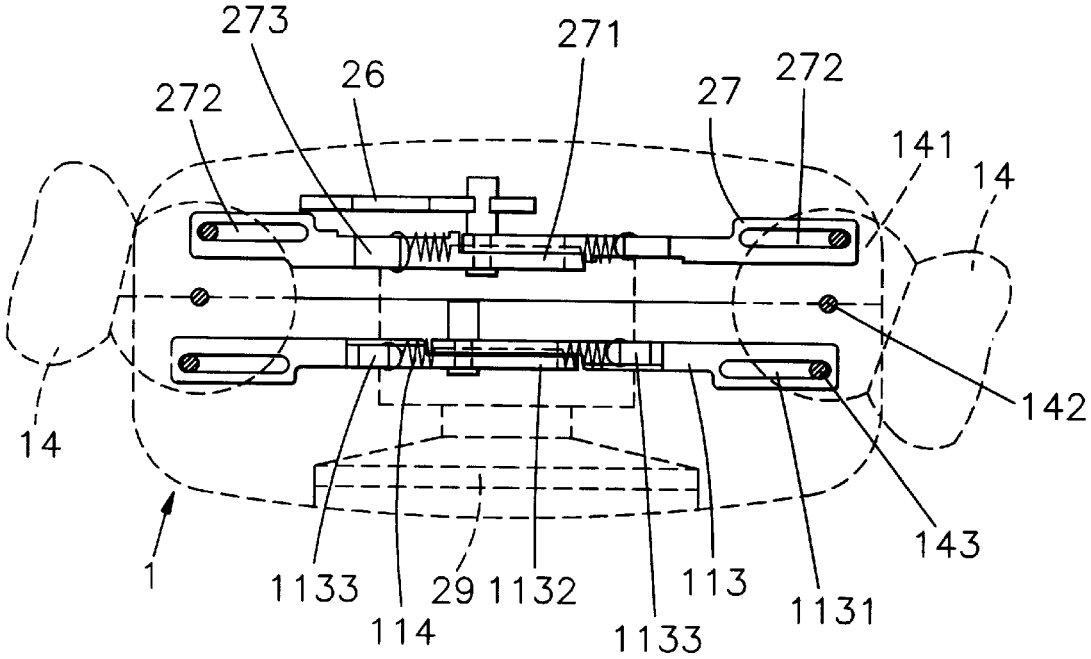
FIG. 7 is a top view of FIG. 5.
Figure 8:
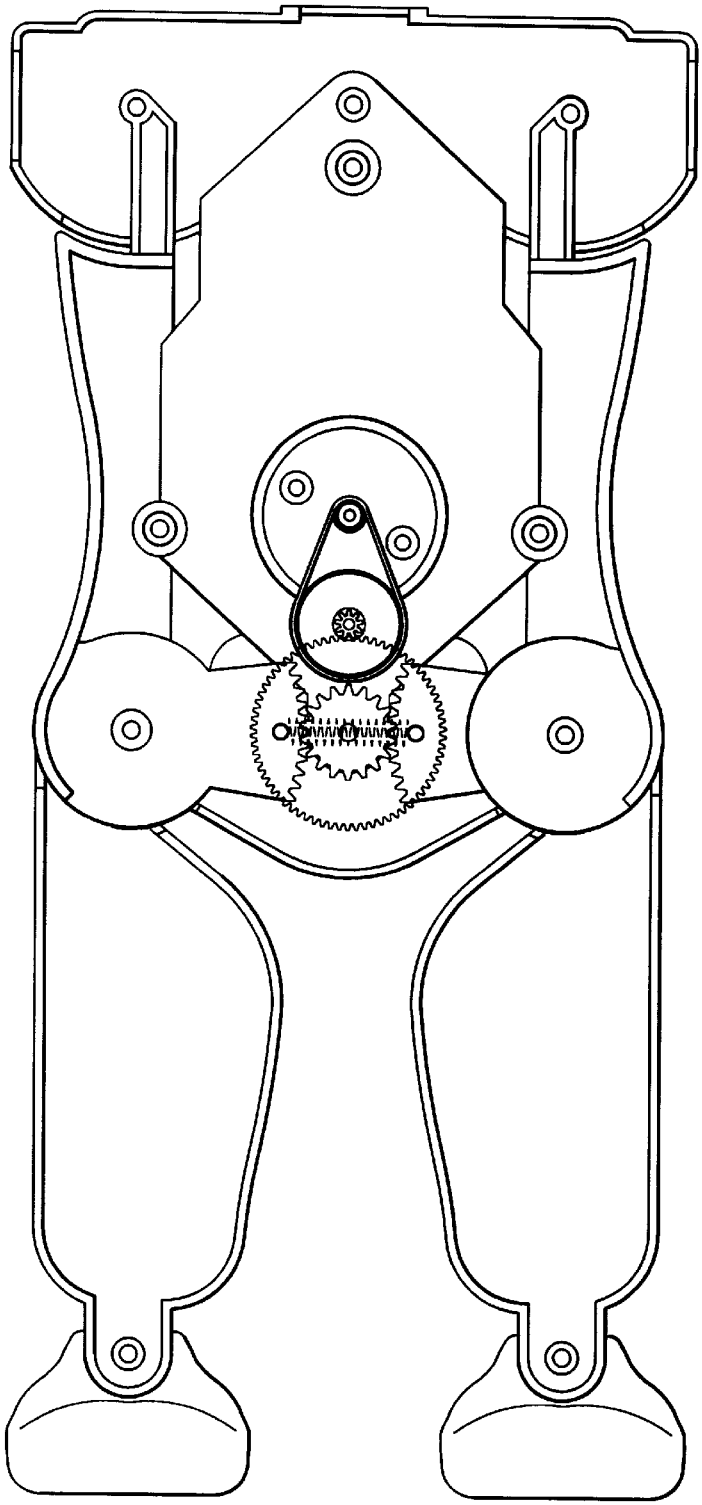
FIG. 8 PRIOR ART
FIG. 8 is a front view in section of a motion toy according to the prior art, showing the arraignment of the main rack.
Figure 9:
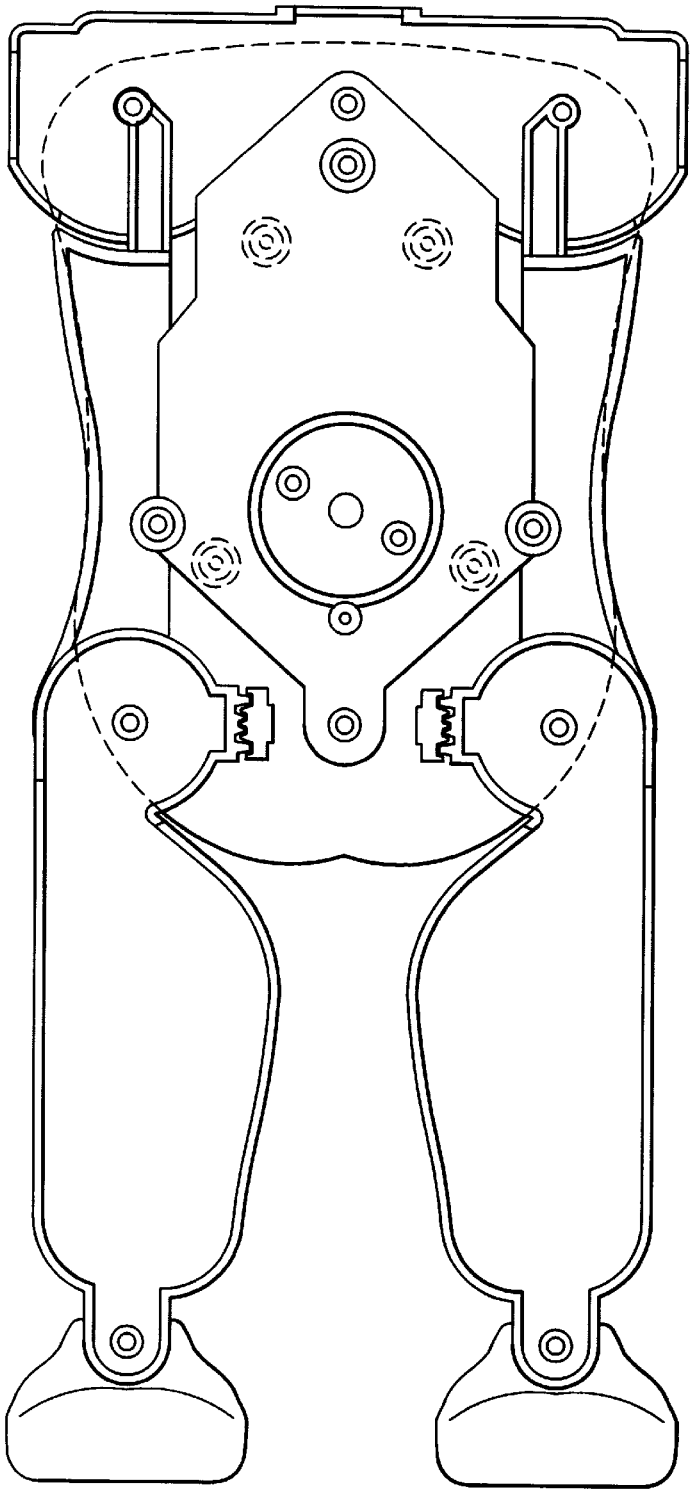
FIG. 9 PRIOR ART
FIG. 9 is another front view in section of the prior art motion toy, showing the arrangement of the auxiliary rack.

Referring to FIGS. 2, 4 and 5 again, as indicated above, when the power drive unit 1 is operated, the legs 15, the body shells 12 and 13, the arms 14, and the head 11 are respectively moved back and forth, simulating the dancing of a person. Further, because a spring 114 or 28 is provided to pull the links 113 or 27 toward each other, the links 113 or 27 are automatically returned after each outward movement. Therefore, the links 113 or 27 can be smoothly moved relative to each other.

Referring to FIGS. 2, 4 and 5 again, the pitch between the shafts 151 at the legs 15 can be narrower than the pitch between the pivots 3, which couple the legs 15 to the feet 16.

While only one embodiment of the present invention has been shown and described, it will be understood that various modifications and changes could be made thereunto without departing from the spirit and scope of the invention disclosed.

What the invention claimed is:

1. A motion toy comprising a toy body, said toy body comprising a front body shell and a rear body shell fastened together, two arms coupled to said front body shell and said rear body shell at two opposite lateral sides, a head piviotable mounted in said front body shell and said rear body shell at a top side by a first pivot means and coupled to said arms, two feet, and two legs coupled between said front body shell and rear body shell and said feet, and a power drive unit controlled to turn said legs, said arms and said head, wherein said power drive unit comprises:

a base frame securely mounted in between said front body dhrll and said rear body shell;

a reversible motor securely mounted on said base frame;

a transmission mechanism coupled between said reversible motor and said center gear for enabling said center gear to be rotated upon operation of said reversible motor;

a rocker turned about a pivot between said front body shell and said rear body shell, said rocker including a second pivot means at a top end thereof, and a smoothly arched rack formed integral with a bottom end thereof and meshed with said center gear; and link means coupled between the second pivot means of said rocker and a respective coupling rod at each of said arms, said link means including a first elongated link having a first coupling hole at one end coupled to the second pivot means of said rocker and a second coupling hole at an opposite end coupled to a respective coupling rod at one of said arms, and a second elongated link having a first coupling hole at one end coupled to the second pivot means of said rocker and a second coupling hole at an opposite end coupled to a respective coupling rod at the other of said arms.

2. The motion toy of claim 1 wherein said head comprises a coupling rod extended from a bottom side thereof, and coupling means which couples said coupling rod to said arms, the link means which couples the coupling rod of said head to said arms comprising a first Z-shaped link having a first coupling hole at one end coupled to a respective coupling rod at one of said arms and a second coupling hole at an opposite end coupled to the coupling rod at said head by a third pivot means, and a second Z-shaped link having a first coupling hole at one end coupled to a respective coupling rod at the other of said arms and second coupling hole at an opposite end coupled to the coupling rod said head by the third pivot means which couples said first Z-shaped link to the coupling rod of said head.

3. The motion toy of claim 1 wherein the link means which couples said rocker to said arms further comprises spring means connected between a hooked middle part at said first elongated link and a hooked middle part at said second elongated link to pull said first elongated link and said second elongated link toward each other.

4. The motion toy of claim 2 wherein the link means which couples said head to said arms further comprises spring means connected between a hooked middle part at said first Z-shaped link and a hooked middle part at said second Z-shaped link to pull said first Z-shaped link and said second Z-shaped link toward each other.

5. The motion toy of claim 1 wherein said legs each comprises a sector-like rack at a top side thereof, said rack being meshed with said center gear of said power drive unit, a fixed shaft disposed across the respective sector-like rack and coupled between said front body shell and said rear body shell by a fourth pivot means, and a bottom end pivoted to one of said feet by a fifth pivot means.

6. The motion toy of claim 5 wherein the pitch between the fixed shafts at said legs is narrower than the pitch between the two fifth pivot means which couple said legs to said feet.

* * * * *